US005102190A

United States Patent [19]

Akin et al.

[11] Patent Number: 5,102,190

[45] Date of Patent: Apr. 7, 1992

[54] PORTABLE SUN SHADE

[76] Inventors: Hewey P. Akin, 4347 Kerwin Dr., Memphis, Tenn. 38128; Jimmy L. Duvall, 5323 Rock Ridge, Memphis, Tenn. 38134

[21] Appl. No.: 553,573

[22] Filed: Jul. 18, 1990

Related U.S. Application Data

[63] Continuation-in-part of Ser. No. 422,056, Oct. 16, 1989, abandoned.

[51] Int. Cl.[5] ..... A47C 7/62

[52] U.S. Cl. ..... 297/184; 135/90

[58] Field of Search ..... 297/184, 218, 226; 5/414; 135/90

[56] References Cited

U.S. PATENT DOCUMENTS

| | | | |
|---|---|---|---|
| 191,782 | 6/1877 | Smith, Sr. | 135/90 X |
| 710,726 | 10/1902 | Valiant | 135/90 X |
| 1,605,679 | 11/1926 | McGrail | 297/184 |
| 1,746,833 | 2/1930 | Hermansen | 135/90 X |
| 2,926,724 | 3/1960 | Rittenberg | 297/184 X |
| 3,243,230 | 3/1966 | Otto | 297/184 |
| 3,845,985 | 11/1974 | Behrend et al. | 297/184 |
| 4,068,673 | 1/1978 | Bernardi | 135/90 X |
| 4,195,879 | 4/1980 | Miller | 297/184 |
| 4,295,481 | 10/1981 | Gee | 297/184 X |
| 4,641,883 | 2/1987 | Kato | 297/184 |
| 4,761,032 | 8/1988 | Sanchez et al. | 297/184 |
| 4,971,089 | 11/1990 | Braman | 297/184 X |

FOREIGN PATENT DOCUMENTS

| | | | |
|---|---|---|---|
| 191104 | 8/1957 | Austria | 135/90 |
| 614724 | 12/1926 | France | 135/90 |
| 16948 | of 1895 | United Kingdom | 135/90 |

*Primary Examiner*—José V. Chen

*Attorney, Agent, or Firm*—Walker & McKenzie

[57] ABSTRACT

A portable sun shade for being mounted on a seat. The portable sun shade includes a canopy; a frame for supporting the canopy above the seat, the frame includes an elongated first frame member having a first end and a second end, an elongated second frame member having a first end and a second end, first structure joining the first ends of the first and second frame members together, an elongated third frame member having a first end and a second end, second structure joining the second ends of the first and third frame members together, an elongated fourth frame member having a first end and a second end, and third structure joining the second ends of the first and fourth frame member together; the canopy being positioned on the third and fourth members; and attaching structure for attaching the frame to the back rest portion of the seat.

6 Claims, 7 Drawing Sheets

PORTABLE SUN SHADE

CROSS-REFERENCE TO RELATED APPLICATION

This is a continuation-in-part of pending application, Ser. No. 07/422,056, filed Oct. 16, 1989 now abandoned and titled "Portable Sun Shade."

BACKGROUND OF THE INVENTION

1. Field of the Invention

The present invention relates, in general, to a device for being removably attached to a back rest portion of a seat to provide shade for the person sitting in that seat.

2. Information Disclosure Statement

A preliminary patentability search conducted in class 297, subclass 184 produced the following patents: Small, U.S. Pat. No. 3,120,978; Otto, U.S. Pat. No. 3,243,230; Ezquerra, U.S. Pat. No. 3,258,291; Kunimatu, U.S. Pat. No. 3,738,703; Biven, U.S. Pat. No. 4,112,957; Musgrove et al., U.S. Pat. No. 4,300,798; Kato, U.S. Pat. No. 4,641;883; Kolb, U.S. Pat. No. 4,781,411; and Munguia, U.S. Pat. No. 4,789,200. All of the above patents disclose portable shading devices or the like and thus appear to relate to the present invention. However, none of the above patents disclose or suggest the present invention. More specifically, none of the above patents disclose or suggest a portable sun shade including a canopy; frame means for supporting the canopy above the seat, the frame means including an elongated first frame member having a first end and a second end, an elongated second frame member having a first end and a second end, first joining means for joining the first ends of the first and second frame members together, an elongated third frame member having a first end and a second end, second joining means for joining the second ends of the first and third frame members together, an elongated fourth frame member having a first end and a second end, and third joining means for joining the second ends of the second and fourth frame member together; and attaching means for attaching the frame means to the back rest portion of the seat.

SUMMARY OF THE INVENTION

The present invention is directed toward providing a portable sun shade for being removably attached to the back rest portion of a seat. The concept of the present invention is to secure a frame means to the back rest portion of a seat as, for example, a swivel chair on a so-called "bass boat", and position a canopy on the frame means.

The portable sun shade of the present invention includes a canopy; frame means for supporting the canopy above the seat, the frame means including an elongated first frame member having a first end and a second end, an elongated second frame member having a first end and a second end, first joining means for joining the first ends of the first and second frame members together, an elongated third frame member having a first end and a second end, second joining means for joining the second ends of the first and third frame members together, an elongated fourth frame member having a first end and a second end, and third joining means for joining the second ends of the second and fourth frame member together; and attaching means for attaching the frame means to the back rest portion of the seat.

DESCRIPTION OF THE PREFERRED EMBODIMENT

Figure 12:
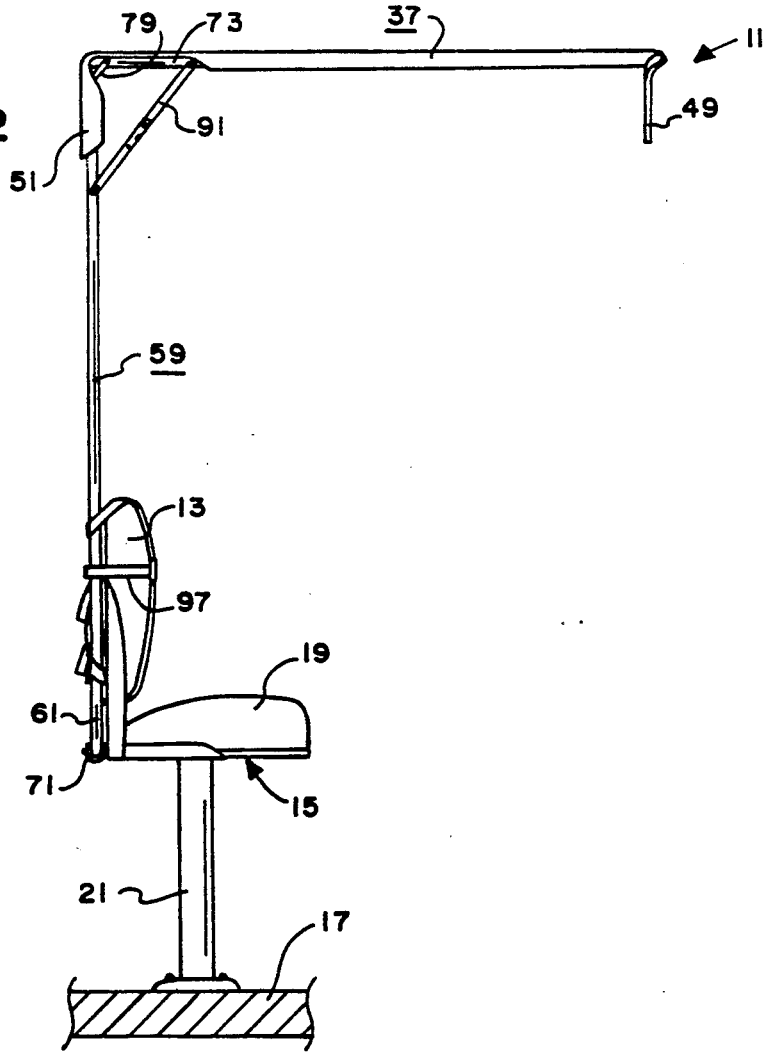
FIG. 12 is a side elevation of the portable sun shade of the present invention mounted on the back rest portion of a boat seat with the attaching means of FIG. 8.
Figure 13:
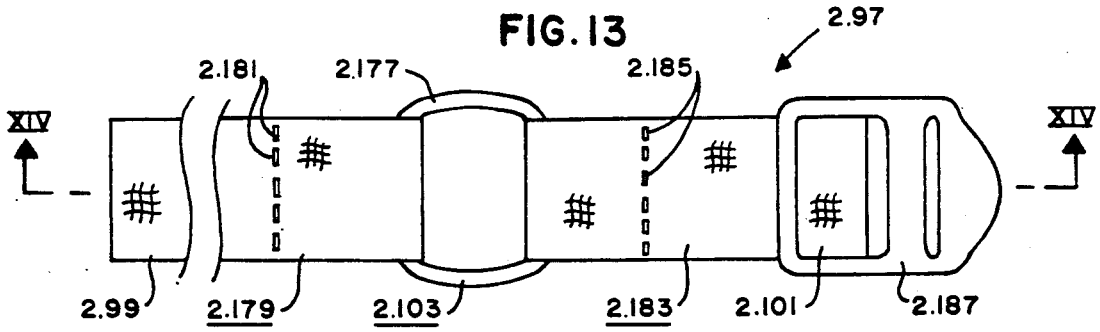
FIG. 13 is a front elevational view of a portion of a second embodiment of the attaching means of the portable sun shade of the present invention with portions thereof broken away for clarity.
Figure 14:
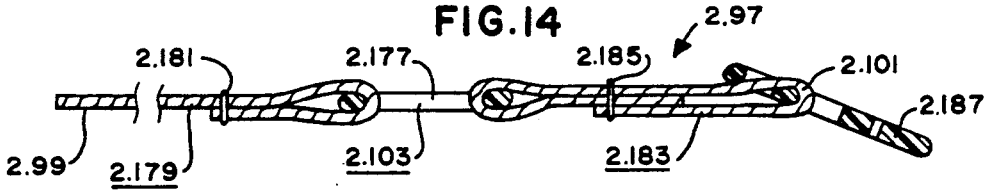
FIG. 14 is a sectional view substantially as taken on line XIV—XIV of FIG. 13.

The preferred embodiment of the portable sun shade 11 of the present invention is for being removably mounted on the back rest portion 13 of a seat 15 of a boat 17 (e.g., a typical "bass" boat) or the like (see, for example, FIG. 12). The seat 15 typically has a seat or base portion 19 supported above the floor of the boat 17 by a pedestal 21 or the like with the back rest portion 13 pivotally attached to the base portion 19. The back rest portion 13 of the seat 15 preferably has a front 25, a first side 27, a second side 29, a top 31, a bottom 33, and a back 35.

Figure 6:
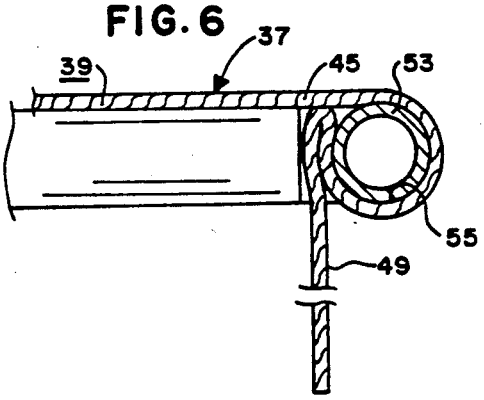
FIG. 6 is an enlarged sectional view of a portion of FIG. 5.

The shade 11 includes a canopy 37 for covering at least a portion of the seat 15. The canopy 37 preferably includes a planar body 39 having a first edge 41, a second edge 43, a front edge 45, and a rear edge 47. The canopy 37 preferably includes a front flap 49 depending from the front edge 45 of the body 39 and a rear flap 51 depending from the rear edge 47 of the body 39. The canopy 37 preferably includes a reinforcing member 53 extending across the front edge 45 of the body 39. The body 39 and flaps 49, 51 are preferably constructed of a flexible fabric such as canvas or the like that will block sunlight, etc., as will now be apparent to those skilled in the art. The body 39, and flaps 49, 51 may be constructed as an integral, one-piece unit out of a single piece of canvas or sewn together out of a plurality of pieces of canvas as will now be apparent to those skilled in the art. Thus, the division between the front and rear edges 45, 47 of the body 39 and the front and rear flaps 49, 51 may consist merely of a fold line or the like as will now be apparent to those skilled in the art. The reinforcing member 53 preferably consists of a length of galvanized pipe or the like held in a loop 55 formed by sewing or the like between the front edge 45 of the body 39 and the front flap 49 as clearly shown in FIG. 6 and as will now be apparent to those skilled in the art.

The shade 11 includes frame means 57 for supporting the canopy 37 above the seat 15. The frame means 57 includes an elongated first frame member 59 having a first end 61 and a second end 63, an elongated second frame member 65 having a first end 67 and a second end 69, first joining means 71 for joining the first ends 61, 67 of the first and second frame members 59, 65 together, an elongated third frame member 73 having a first end 75 and a second end 77, second joining means 79 for joining the second ends 63, 77 of the first and third frame members 59, 73 together, an elongated fourth frame member 81 having a first end 83 and a second end 85, and third joining means 87 for joining the second ends 69, 85 of the second and fourth frame members 65, 81 together. Each frame member 59, 65, 73, 81 preferably consists of a length of galvanized pipe or the like. Each joining means 71, 79, 87 preferably includes pivot means for allowing the frame means 57 to be easily folded between a compact, out-of-use position and an in-use position. The specific construction of each pivot means may vary as will now be apparent to those skilled in the art.

The frame means 57 preferably includes a first brace means 89 for extending between the first and second frame members 59, 65, a second brace means 91 for extending between the first and third frame members 59, 73, and a third brace means 93 for extending between the second and fourth frame members 65, 81. The brace means 89, 91, 93 strengthen the frame means 57 when the frame means 57 is in the in-use position and hold the frame members 59, 65, 73, 81 in the in-use position as will now be apparent to those skilled in the art. The brace means 89, 91, 93 are preferably pivotal to allow the frame means 57 to be easily folded to the compact, out-of-use position. The construction and operation of the brace means 89, 91, 93 may vary as will now be apparent to those skilled in the art.

Figure 1:
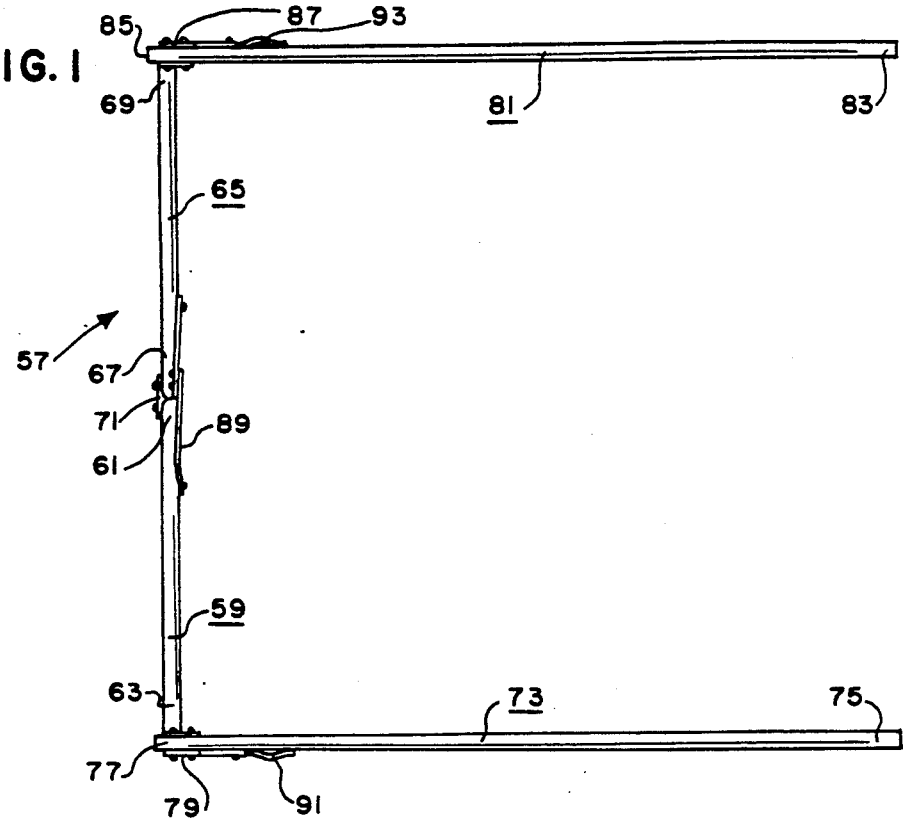
FIG. 1 is a top plan view of the frame means of the portable sun shade of the present invention in an open position.
Figure 2:
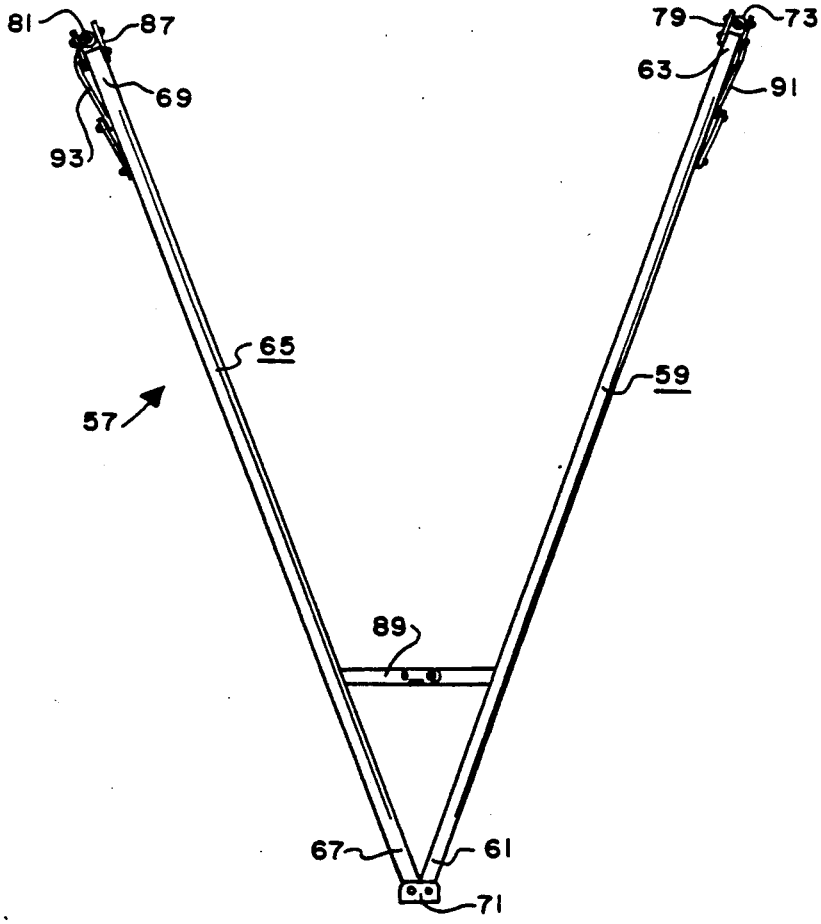
FIG. 2 is a rear elevation showing the frame means of FIG. 1.
Figure 3:
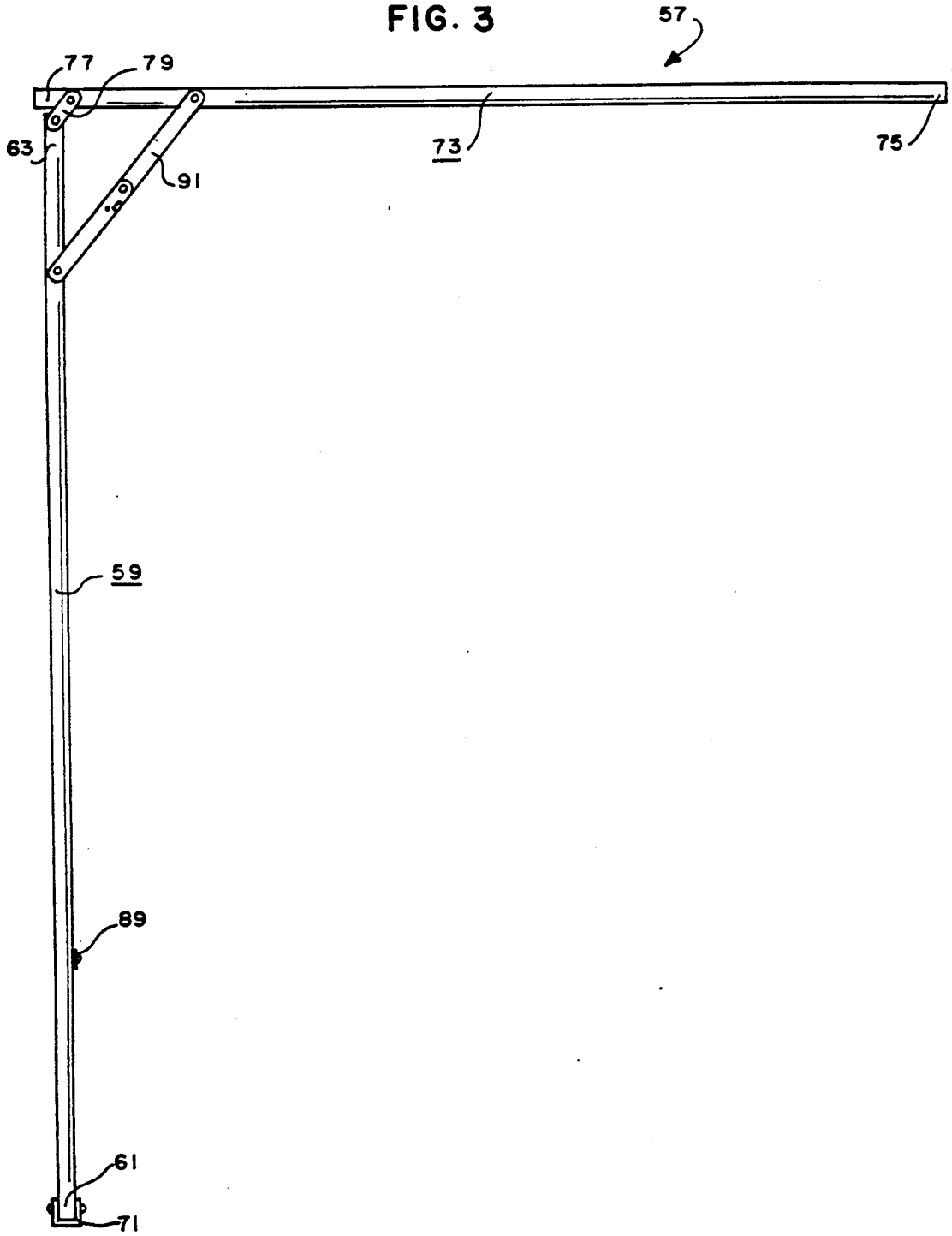
FIG. 3 is a side elevation showing the frame means of FIG. 1.
Figure 4:
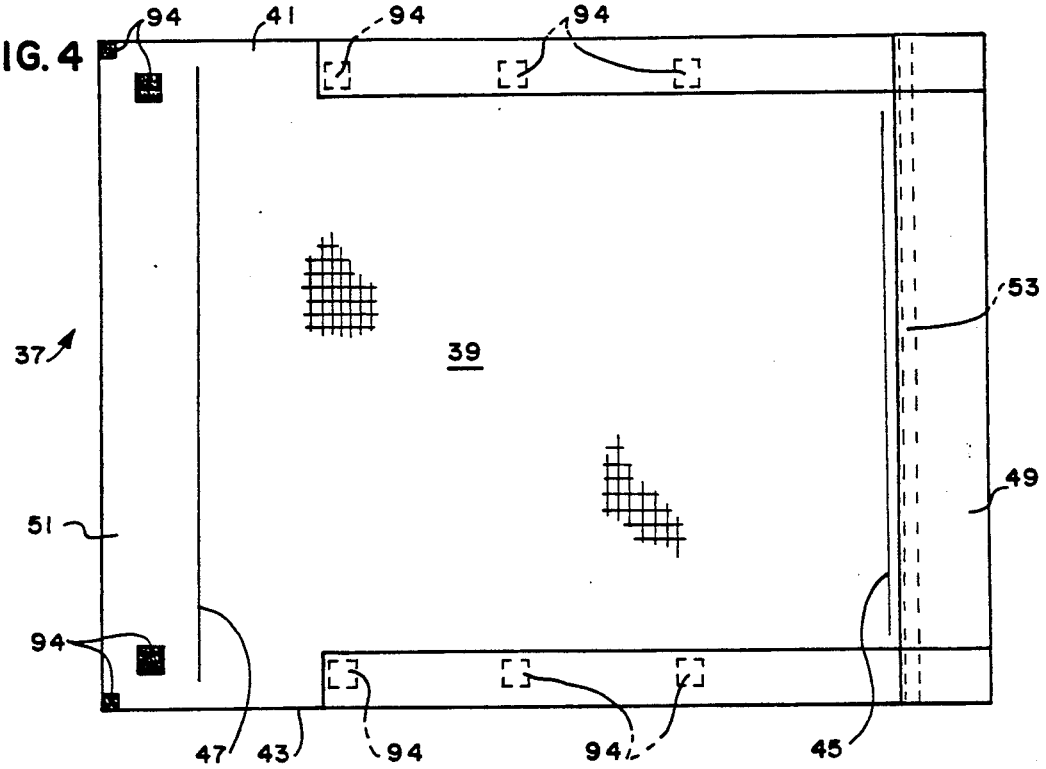
FIG. 4 is a bottom plan view of a canopy of the portable sun shade of the present invention.
Figure 5:
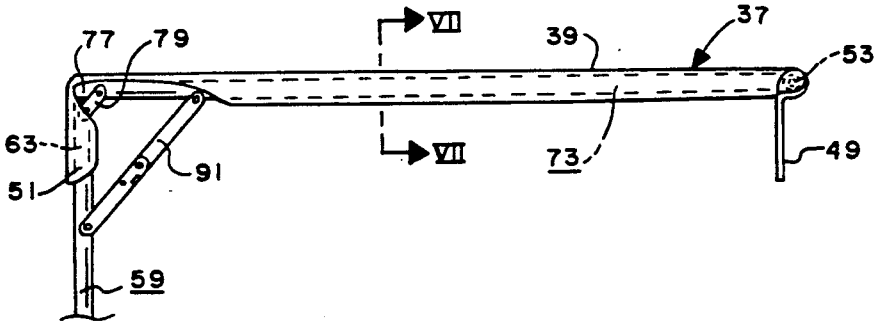
FIG. 5 is a side elevation of a portion of the frame means of FIG. 1 with the canopy of FIG. 4 positioned thereon.
Figure 7:
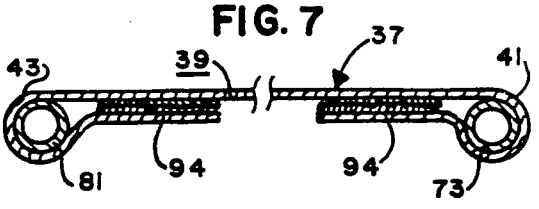
FIG. 7 is an enlarged sectional view substantially as taken on line VII—VII of FIG. 5 with portions thereof broken away for clarity.

The canopy 37 is preferably positioned on the third and fourth frame members 73, 81. More specifically, the canopy 37 preferably includes fastening means for fastening the first edge 41 of the body 39 to the third frame member 73, for fastening the second edge 43 of the body 39 to the fourth frame member 81, and for fastening the rear flap 51 to the first and second frame members 59, 65. The construction and operation of the fastening means may vary as will now be apparent to those skilled in the art. For example, the fastening means may consist of coacting Velcro-type fastening members 94, etc. (see FIGS. 4 and 7), to allow portions of the canopy 37 to be wrapped about portions of the frame means 57 to snugly secure the canopy 37 to the frame means 57 as will now be apparent to those skilled in the art.

The shade 11 includes attaching means for attaching the frame means 57 to the seat 15.

A first embodiment of the attaching means is shown in FIGS. 8–12 and identified by the numeral 95. The attaching means 95 preferably includes an elongated first arm 97 having a first end 99 for being positioned substantially centrally of the front 25 of the back rest portion 13 having a second end 101 for extending substantially horizontally around the first side 27 of the back rest portion 13 of the seat 15. The second end 101 of the first arm 97 is removably attachable to the frame means 57. More specifically, the attaching means 95 preferably includes a first arm attachment means 103 for attaching the second end 101 of the first arm 97 to the first frame member 59 of the frame means 57. The first arm attachment means 103 preferably has adjustment means including a buckle or the like for allowing adjustment of the first arm 97 relative to the back rest portion 13 as will now be apparent to those skilled in the art. The attaching means 95 preferably includes an elongated second arm 105 having a first end 107 for being positioned substantially centrally of the front 25 of the back rest portion 13 and having a second end 109 for extending substantially horizontally around the second side 29 of the back rest portion 13. The second end 109 of the second arm 105 is attachable to the frame means 57. More specifically, the attaching means 95 preferably includes a second arm attachment means 111 for attaching the second end 109 of the second arm 105 to the second frame member 65 of the frame means 57. The second arm attachment means 111 may include a loop formed in the second end 109 of the second arm 105 for encircling the second frame member 65.

The attaching means 95 preferably includes an elongated third arm 113 having a first end 115 for being positioned substantially centrally of the front 25 of the back rest portion 13 and having a second end 117 for extending substantially vertically over the top 31 of the back rest portion 13. The second end 117 of the third arm 113 is attachable to the frame means 57. More specifically, the attaching means 95 preferably includes a third arm attachment means 119 for attaching the second end 117 of the third arm 113 to the first brace means 89. The third arm attachment means 119 preferably includes a rivet or the like for fixedly attaching the third arm 113 first brace means 89 as will now be apparent to those skilled in the art. The attaching means 95 preferably includes an elongated fourth arm 121 having a first end 123 for being positioned substantially centrally of the front 25 of the back rest portion 13 and having a second end 125 for extending substantially vertically over the top 31 of the back rest portion 13. The second end 125 of the fourth arm 121 is attachable to the frame means 57. More specifically, the attaching means 95 preferably includes a fourth arm attachment means 127 for attaching the second end 125 of the fourth arm 121 to the first brace means 89. The fourth arm attachment means 127 preferably includes a rivet or the like for fixedly attaching the fourth arm 121 to the first brace means 89 as will now be apparent to those skilled in the art.

The attaching means 95 preferably includes an elongated fifth arm 129 having a first end 131 for being positioned substantially centrally of the front 25 of the back rest portion 13 and having a second end 133 for extending substantially vertically over the top 31 of the back rest portion 13. The second end 133 of the fifth arm 129 is preferably removably attachable to the frame means 57. More specifically, the attaching means 95 preferably includes a fifth arm attachment means 135 for attaching the second end 133 of the fifth arm 129 to the first frame member 59. The fifth arm attachment means 135 preferably has adjustment means including a buckle or the like for allowing adjustment of the fifth arm 129 relative to the back rest portion 13 as will now be apparent to those skilled in the art. The attaching means 95 preferably includes an elongated sixth arm 137 having a first end 139 for being positioned substantially centrally of the front 25 of the back rest portion 13 and having a second end 141 for extending substantially vertically over the top 31 of the back rest portion 13. The second end 143 of the sixth arm 137 is preferably removably attachable to the frame means 57. More specifically, the attaching means 95 preferably includes a sixth arm attachment means 143 for attaching the second end 141 of the sixth arm 137 to the second frame member 65. The sixth arm attachment means 143 preferably has adjustment means including a buckle or the like for allowing adjustment of the sixth arm 137 relative to the back rest portion 13 as will now be apparent to those skilled in the art.

The attaching means 95 preferably includes an elongated seventh arm 145 having a first end 147 for being positioned substantially centrally of the front 25 of the back rest portion 13 and having a second end 149 for extending substantially vertically under the bottom 33 of the back rest portion 13. The second end 149 of the seventh arm 145 is preferably removably attachable to the frame means 57. More specifically, the attaching means 95 preferably includes a seventh arm attachment means 151 for attaching the second end 149 of the seventh arm 145 to the first frame member 59. The seventh arm attachment means 151 preferably has adjustment means including a buckle or the like for allowing adjustment of the seventh arm 145 relative to the back rest portion 13 as will now be apparent to those skilled in the art. The attaching means 95 preferably includes an elongated eighth arm 153 having a first end 155 for being positioned substantially centrally of the front 25 of the back rest portion 13 and having a second end 157 for extending substantially vertically under the bottom 33 of the back rest portion 13. The second end 157 of the eighth arm 153 is preferably removably attachable to the frame means 57. More specifically, the attaching means 95 preferably includes an eighth arm attachment means 159 for attaching the second end 157 of the eighth arm 153 to the second frame member 65. The eighth arm attachment means 159 preferably has adjustment means including a buckle or the like for allowing adjustment of the eighth arm 153 relative to the back rest portion 13 as will now be apparent to those skilled in the art.

Figure 8:
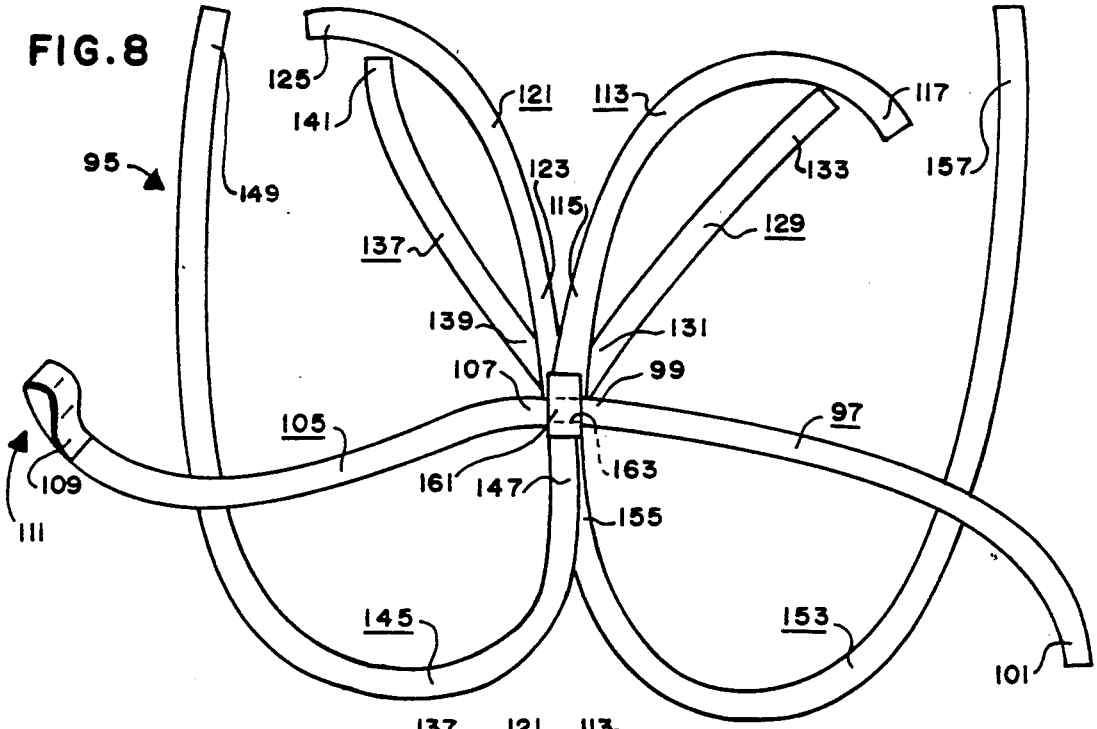
FIG. 8 is a somewhat diagrammatic rear elevation of a first embodiment of the attaching means of the portable sun shade of the present invention.
Figure 9:
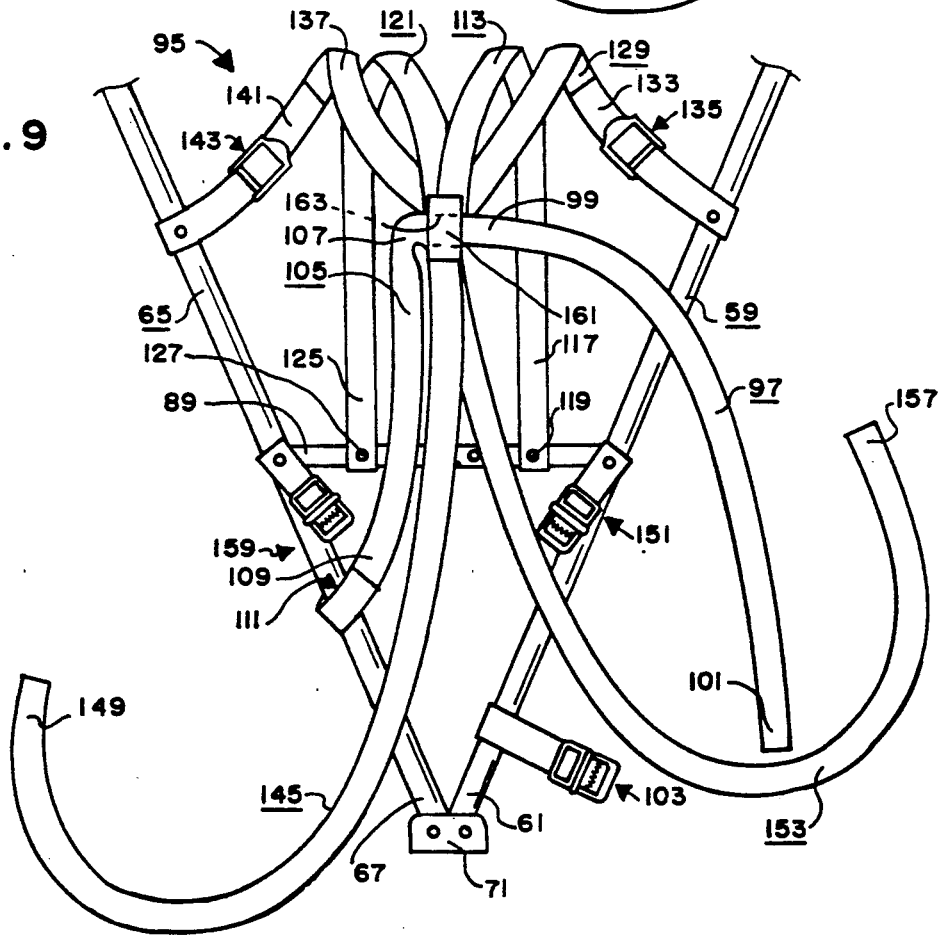
FIG. 9 is a somewhat diagrammatic rear elevation of the attaching means of FIG. 8 attached to a portion of the frame means.
Figure 10:
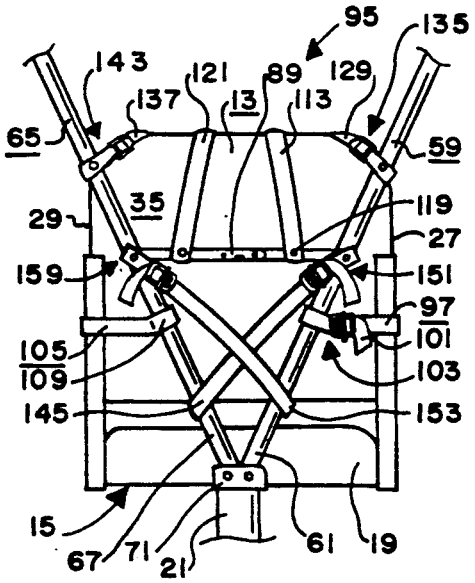
FIG. 10 is a rear view of a portion of the portable sun shade of the present invention mounted on the back rest portion of a seat with the attaching means of FIG. 8.
Figure 11:
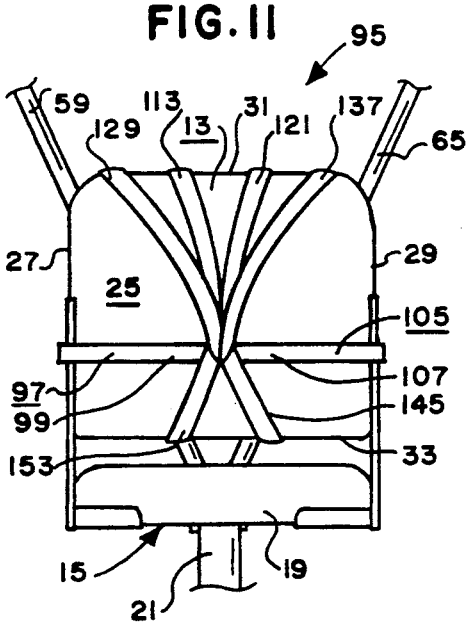
FIG. 11 is a front view of a portion of the portable sun shade of the present invention mounted on the back rest portion of a seat with the attaching means of FIG. 8.

The specific construction and operation of the attaching means 95 may vary as will now be apparent to those skilled in the art. Preferably, the arms 97, 105, 113, 121, 129, 137, 145, 153 are constructed out of nylon webbing or the like with the first ends 115, 123, 131, 139, 147, 155 joined together by sewing or the like at angles to one another to form a central body portion 161 substantially as shown in FIGS. 8 and 9 for being placed substantially centrally of the front 25 of the back rest portion 13 substantially as shown in FIG. 11. A loop or tunnel 163 is preferably formed by the central body portion 161 for slidably receiving the first ends 99, 107 of the first and second arms 97, 105. The first and second arms 97, 105 are preferably construed as a one-piece, integral strap for slidably extending through the tunnel 163 to allow the first and second arms 97, 105 to be tightened snugly about the back rest portion 13 by merely adjusting the first arm attachment means 103 in a belt-like manner as will now be apparent to those skilled in the art.

Figure 15:
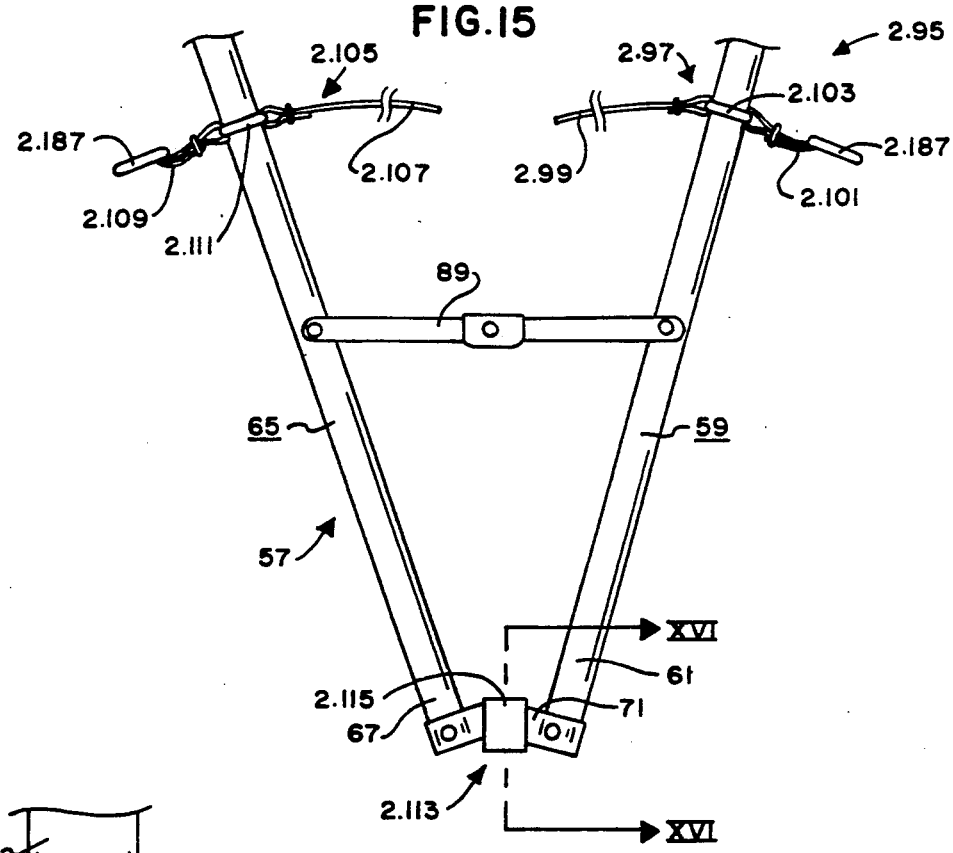
FIG. 15 is a rear view of a portion of the frame means of the portable sun shade of the present invention with portions of the second embodiment of the attaching means mounted thereon.
Figure 16:
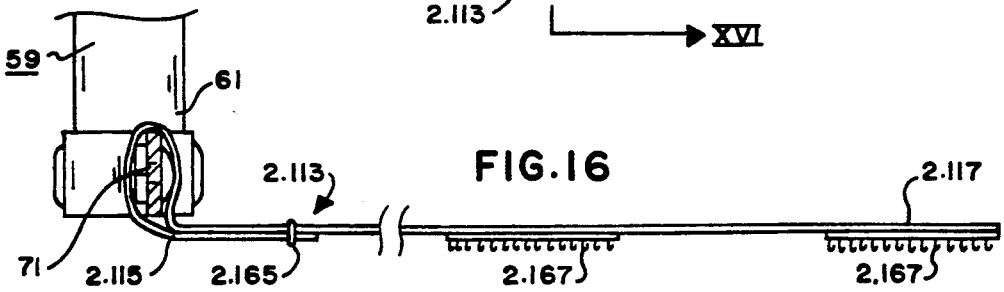
FIG. 16 is an enlarged sectional view substantially as taken on line XVI—XVI of FIG. 15 with portions thereof broken away for clarity.

A second embodiment of the attaching means is shown in FIGS. 13–20 and identified by the numeral 2.95. The attaching means 2.95 preferably includes an elongated first arm 2.97 having a first end 2.99 and a second end 2.101. The first arm 2.97 is preferably removably attachable to the frame means 57. More specifically, the first arm 2.97 preferably includes a first arm attachment means 2.103 for attaching the first arm 2.97 to the first frame member 59 of the frame means 57. The first arm attachment means 2.103 is preferably positioned between the first and second ends 2.99, 2.103 of the first arm 2.97 and is preferably adapted to slip over the first frame member 59 as shown in FIG. 15. The attaching means 2.95 preferably includes an elongated second arm 2.105 having a first end 2.107 and a second end 2.109. The second arm 2.105 is preferably removably attachable to the frame means 57. More specifically, the second arm 2.105 preferably includes a second arm attachment means 2.111 for removably attaching the second arm 2.105 to the second frame member 65 of the frame means 57. The second arm attachment means 2.111 is preferably positioned between the first and second ends 2.107, 2.109 of the second arm 2.105 and is preferably adapted to slip over the second frame member 65 as shown in FIG. 15.

Figure 17:
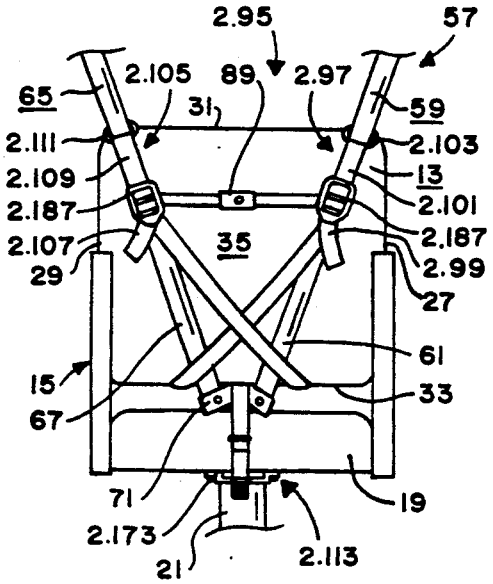
FIG. 17 is a rear view of a portion of the portable sun shade of the present invention mounted on the back rest portion of a seat with the second embodiment of the attaching means.
Figure 18:
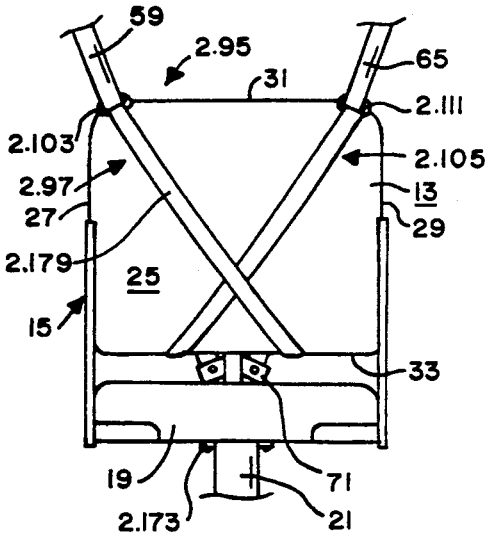
FIG. 18 is a front view of a portion of the portable sun shade of the present invention mounted on the back rest portion of a seat with the second embodiment of the attaching means.

The attaching means 2.95 preferably includes an elongated third arm 2.113 having a first end 2.115 for being attached to the frame means 57 and having a second end 2.117 for being attached to the seat 15. The third arm 2.113 preferably consists of an elongated length of flexible nylon webbing. or the like with the first end 2.115 thereof looped around the first joining means 71 of the frame means 57, folded back on itself, and secured together by stitches 2.165 or the like as clearly shown in FIG. 16 to fixedly attach the third arm 2.113 to the frame means 57 as will now be apparent to those skilled in the art. The first joining means 71 used with the attaching means 2.95 is preferably somewhat elongated as shown in FIGS. 15 and 17 and as compared with the one used with the attaching means 95 (see FIG. 9) to provide sufficient room between the first ends 61, 67 of the respective frame means 59, 65 for the first end 2.115 of the third arm 2.113 as will now be apparent to those skilled in the art. Coacting fastening means 2.167 is preferably attached to the second end 2.117 of the third arm 2.113 to allow the second end 2.117 to be removably and adjustably attached to the seat 15 in a manner to be described hereinbelow. The construction and operation of the fastening means 2.167 may vary as will now be apparent to those skilled in the art. For example, the fastening means 2.167 may consist of coacting Velcro-type hook-and-pile fastening members etc., as will now be apparent to those skilled in the art.

Figure 19:
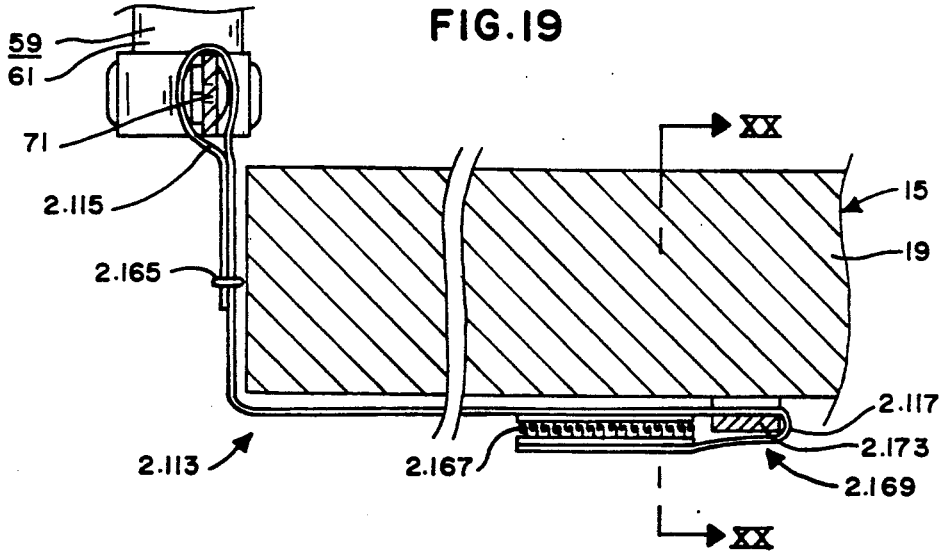
FIG. 19 is an enlarged sectional view of a portion of FIG. 17 showing additional details of the second embodiment of the attaching means.
Figure 20:
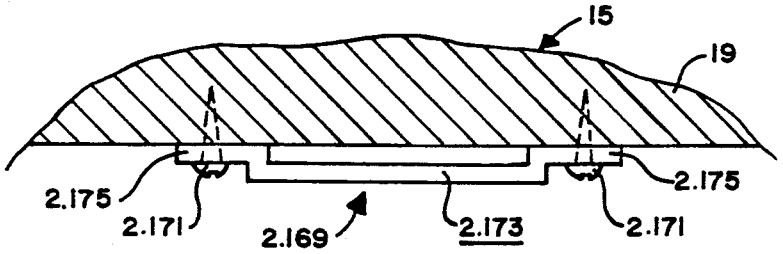
FIG. 20 is a sectional view substantially as taken on line XX—XX of FIG. 19 with portions thereof omitted for clarity.

The attaching means 2.95 preferably includes ring means 2.169 for being attached to the bottom of the base portion 19 of the seat 15 by screws 2.171 or the like as clearly shown in FIGS. 19 and 20. The ring means 2.169 preferably includes a generally U-shaped bracket 2.173 having flanges 2.175 on the upper ends of each leg thereof through which the screws 2.171 extend to attach the bracket 2.173 to the bottom of the base portion 19 of the seat 15. The bracket 2.173 thus coacts with the bottom of the base portion 19 of the seat 15 to form a slot or ring through which the distal portion of second end 2.117 of the third arm 2.113 can be extended as clearly shown in FIG. 19. More specifically, to attach the third arm 2.113 to the seat 15, the second end 2.117 of the third arm 2.113 is inserted through the slot or ring formed by the bracket 2.173, looped around the bracket 2.173, folded back on itself, and secured together by the fastening means 2.167 as clearly shown in FIG. 19 which will now be apparent to those skilled in the art.

The first and second arms 2.97, 2.105 are preferably identical to one another and a detailed description of the first arm 2.97 will suffice for both. The first arm attachment means 2.103 preferably consists of a ring member 2.177 sized to slip over the first frame member 59. The ring member 2.177 may be constructed out of plastic or the like in any manner now apparent to those skilled in the art. The first arm 2.97 preferably includes an elongated strap 2.179 for extending from the ring member 2.177 to the first end 2.99 of the first arm 2.97. The strap 2.179 preferably consists of an elongated length of flexible nylon webbing or the like with one end thereof looped through the ring member 2.177, folded back on itself, and secured together by stitches 2.181 or the like as clearly shown in FIG. 14 to fixedly attach the strap 2.179 to the ring member 2.177 as will now be apparent to those skilled in the art. The first arm 2.97 preferably includes an elongated strap 2.183 for extending from the ring member 2.177 to the second end 2.101 of the first arm 2.97. The strap 2.183 preferably consists of an elongated length of flexible nylon webbing or the like with one end thereof looped through the ring member 2.177, folded back on itself, and secured together by stitches 1.185 or the like as clearly shown in FIG. 14 to fixedly attach the strap 2.183 to the ring member 2.177 as will now be apparent to those skilled in the art. The first arm 2.97 preferably includes buckle means 2.187 for removably and adjustably securing the first end 2.99 thereof to the second end 2.101 thereof. The buckle means 2.187 preferably consists of any standard friction-type buckle well known to those skilled in the art which allows the free end of the elongated strap 2.179 to be securely attached thereto in a manner which will now be apparent to those skilled in the art. The end of the strap 2.183 opposite the ring member 2.103 is preferably looped through the buckle means 2.187, folded back on itself, and secured together by the stitches 1.185 or the like as clearly shown in FIG. 14 to fixedly attach the buckle means 2.187 to the strap 2.183 as will now be apparent to those skilled in the art.

To attach the shade 11 to the back rest portion 13 of the seat 15, the first and second arms 2.97, 2.105 are positioned on the respective frame members 59, 65 using the respective attachment means 2.103, 2.111. The third arm 2.113 is attached to the bottom of the base portion 19 of the seat 15 using the ring means 2.169. The first end 2.99 of the first arm 2.97 is angled over the top edge of the back rest portion 13, across the front of the back rest portion 13, under the bottom edge of the back rest portion 13, and across the back of the back rest portion 13 as clearly shown in FIGS. 17 and 18. The distal end of the first end 2.99 is then attached to the buckle means 2.187 of the first arm 2.97 and tightened to thereby secure the first arm 2.97 to the back rest portion 13 as will now be apparent to those skilled in the art. The first end 2.107 of the second arm 2.105 is angled over the top edge of the back rest portion 13, across the front of the back rest portion 13, under the bottom edge of the back rest portion 13, and across the back of the back rest portion 13 as clearly shown in FIGS. 17 and 18. The distal end of the first end 2.107 is then attached to the buckle means 2.187 of the second arm 2.105 and tightened to thereby secure the second arm 2.105 to the back rest portion 13 as will now be apparent to those skilled in the art. It is important to make sure the fastening means 2.167 is fastened securely to prevent the shade 11 from tipping over.

Although the present invention has been described and illustrated with respect to a preferred embodiment and a preferred use therefor, it is not to be so limited since modifications and changes can be made therein which are within the full intended scope of the invention.

I claim:

1. A portable sun shade for being mounted on a seat having a back rest portion, said back rest portion having a front, a first side, a second side, a top, a bottom, and a back; said portable sun shade comprising:

a) a canopy;

b) frame means for supporting said canopy above said seat, said frame means including an elongated first frame member having a first end and a second end, an elongated second frame member having a first end and a second end, first joining means for joining said first ends of said first and second frame members together, an elongated third frame member having a first end and a second end, second joining means for joining said second ends of said first and third frame members together, an elongated fourth frame member having a first end and a second end, and third joining means for joining said second ends of said second and fourth frame members together, said canopy being positioned on said third and fourth frame members; and c) attaching means for attaching said frame means to said back rest portion of said seat; said attaching means including an elongated first arm having a first end for being positioned substantially centrally of said front of said back rest portion having a second end for extending substantially horizontally around said first side of said back rest portion of said seat, said second end of said first arm being removably attachable to said frame means; and said attaching means including an elongated second arm having a first end for being positioned substantially centrally of said front of said back rest portion and having a second end for extending substantially horizontally around said second side of said back rest portion, said second end of said second arm being attachable to said frame means; said attaching means including an elongated third arm having a first end for being positioned substantially centrally of said front of said back rest portion and having a second end for extending substantially vertically over said top of said back rest portion, said second end of said third arm being attachable to said frame means; said attaching means including an elongated fourth arm having a first end for being positioned substantially centrally of said front of said back rest portion and having a second end for extending substantially vertically over said top of said back rest portion, said second end of said fourth arm being attachable to said frame means; said attaching means including an elongated fifth arm, having a first end for being positioned substantially centrally of said front of said back rest portion and having a second end for extending substantially vertically over said top of said back rest portion, said second end of said fifth arm being removably attachable to said frame means; said attaching means including an elongated sixth arm having a first end for being positioned substantially centrally of said front of said back rest portion and having a second end for extending substantially vertically over said top of said back rest portion, said second end of said sixth arm being removably attachable to said frame means.

2. The portable sun shade of claim 1 in which said attaching means includes an elongated seventh arm having a first end for being positioned substantially centrally of said front of said back rest portion and having a second end for extending substantially vertically under said bottom of said back rest portion, said second end of said seventh arm being removably attachable to said frame means; and in which said attaching means includes an elongated eighth arm having a first end for being positioned substantially centrally of said front of said back rest portion and having a second end for extending substantially vertically under said bottom of said back rest portion, said second end of said eighth arm being removably attachable to said frame means.

3. The portable sun shade of claim 2 in which said frame means includes a first brace means for extending between said first and second frame members, a second brace means for extending between said first and third frame members, and a third brace means for extending between said second and fourth frame members.

4. The portable sun shade of claim 3 in which said attaching means includes a first arm attachment means for attaching said second end of said first arm to said first frame member of said frame means; in which said attaching means includes a second arm attachment means for attaching said second end of said second arm to said second frame member of said frame means; in which said attaching means includes a third arm attachment means for attaching said second end of said third arm to said first brace means of said frame means; in which said attaching means includes a fourth arm attachment means for attaching said second end of said fourth arm to said first brace means of said frame means; in which said attaching means includes a fifth arm attachment means for attaching said second end of said fifth arm to said first frame member of said frame means; in which said attaching means includes a sixth arm attachment means for attaching said second end of said sixth arm to said second frame member of said frame means; in which said attaching means includes a seventh arm attachment means for attaching said second end of said seventh arm to said first frame member of said frame means; and in which said attaching means includes an eighth arm attachment means for attaching said second end of said eighth arm to said second frame member of said frame means.

5. The portable sun shade of claim 4 in which said first ends of said third, fourth, fifth, sixth, seventh and eighth arms are joined together to form a central body portion for being placed substantially centrally of said front of said back rest portion; in which said first ends of said first and second arms are joined to one another, and in which said central body portion includes a tunnel for slidably receiving said first ends of said first and second arms.

6. The combination of a portable sun shade with a boat seat having a seat portion and a back rest portion; said back rest portion having a front, a first side, a second side, a top, a bottom, and a back; said portable sun shade comprising:

a) a canopy including a planar body having a first edge, a second edge, a front edge, and a rear edge; said canopy including a front flap depending from said front edge of said body and including a rear flap depending from said rear edge of said body; said canopy including a reinforcing member extending across said front edge of said body;

b) frame means supporting said canopy above said seat, said frame means including an elongated first frame member having a first end and a second end, an elongated second frame member having a first end and a second end, first pivot means pivotally joining said first ends of said first and second frame members together, an elongated third frame member having a first end and a second end, second pivot means pivotally joining said second ends of said first and third frame members together, an elongated fourth frame member having a first end and a second end, and a third pivot means pivotally joining said second ends of said second and fourth frame members together; said frame means including a first brace means extending between said first and second frame members, a second brace means extending between said first and third frame members, and a third brace means extending between said second and fourth frame members; said first edge of said canopy being removably attached to said third frame member, said second edge of said canopy being removably attached to said fourth frame member, said rear flap of said canopy being removably attached to said first and second frame members; and c) attaching means attaching said frame means to said back rest portion of said seat; said attaching means including an elongated first arm having a first end being positioned substantially centrally of said front of said back rest portion having a second end extending substantially horizontally around said first side of said back rest portion of said seat, said second end of said first arm being removably attachable to said frame means; said attaching means including an elongated second arm having a first end being positioned substantially centrally of said front of said back rest portion and having a second end extending substantially horizontally around said second side of said back rest portion, said second end of said second arm being removably attached to said frame means; said attaching means including an elongated third arm having a first end being positioned substantially centrally of said front of said back rest portion and having a second end extending substantially vertically over said top of said back rest portion, said second end of said third arm being attached to said frame means; said attaching means including an elongated fourth arm having a first end being positioned substantially centrally of said front of said back rest portion and having a second end extending substantially vertically over said top of said back rest portion, said second end of said fourth arm being attached to said frame means; said attaching means including an elongated fifth arm having a first end being positioned substantially centrally of said front of said back rest portion and having a second end extending substantially vertically over said top of said back rest portion, said second end of said fifth arm being removably attached to said frame means; said attaching means including an elongated sixth arm having a first end being positioned substantially centrally of said front of said back rest portion and having a second end extending substantially vertically over said top of said back rest portion, said second end of said sixth arm being removably attached to said frame means; said attaching means including an elongated seventh arm having a first end being positioned substantially centrally of said front of said back rest portion and having a second end extending substantially vertically under said bottom of said back rest portion, said second end of said seventh arm being removably attached to said frame means; said attaching means including an elongated eighth arm having a first end being positioned substantially centrally of said front of said back rest portion and having a second end extending substantially vertically under said bottom of said back rest portion, said second end of said eighth arm being removably attached to said frame means; said attaching means including a first arm attachment means attaching said second end of said first arm to said first frame member of said frame means; said attaching means including a second arm attachment means attaching said second end of said second arm to said second frame member of said frame means; said attaching means including a third arm attachment means attaching said second end of said third arm to said first brace means of said frame means; said attaching means including a fourth arm attachment means attaching said second end of said fourth arm to said first brace means of said frame means; said attaching means including a fifth arm attachment means attaching said second end of said fifth arm to said first frame member of said frame means; said attaching means including a sixth arm attachment means attaching said second end of said sixth arm to said second frame member of said frame means; said attaching means including a seventh arm attachment means attaching said second end of said seventh arm to said first frame member of said frame means; said attaching means including an eighth arm attachment means attaching said second end of said eighth arm to said second frame member of said frame means.

* * * * *